United States Patent [19]

Bell

[11] Patent Number: 4,619,200

[45] Date of Patent: Oct. 28, 1986

[54] IMPACT IGNITION DEVICE FOR A PLURALITY OF STAB TYPE PRIMERS

[75] Inventor: Frank H. Bell, Logan, Utah

[73] Assignee: Morton Thiokol, Inc., Chicago, Ill.

[21] Appl. No.: 716,728

[22] Filed: Mar. 27, 1985

[51] Int. Cl.[4] ..... F42C 1/02

[52] U.S. Cl. ..... 102/275; 102/265; 102/273; 102/204

[58] Field of Search ..... 102/272, 273, 275, 265, 102/200, 204, 275.11

[56] References Cited

U.S. PATENT DOCUMENTS

| | | | |
|---|---|---|---|
| 431,374 | 7/1890 | Merriam | 102/265 |
| 431,375 | 7/1890 | Merriam | 102/273 X |
| 559,495 | 5/1896 | Rapieff | 102/265 X |
| 668,618 | 2/1901 | Alessi | 102/272 |
| 1,042,830 | 10/1912 | Sokolowski | 102/275 |
| 1,317,611 | 9/1919 | Barlow | 102/272 |
| 3,948,176 | 4/1976 | Koomen | 102/204 |

FOREIGN PATENT DOCUMENTS

| | | | |
|---|---|---|---|
| 22193 | 12/1920 | France | 102/273 |
| 246995 | 4/1926 | Italy | 102/273 |

*Primary Examiner*—David H. Brown
*Attorney, Agent, or Firm*—Gerald K. White

[57] ABSTRACT

A multi-path impact type, inertia class, igniter for use with both rotating and non-rotating projectiles or warheads includes two or more stab type "firing pins" that are arranged in a plane which is at 90° to the center-line of the projectile. The firing pins are equally spaced apart on the plane and each bears directly upon a safety rupture-disc. The rupture-discs bear directly upon stab type primers, there being one primer per disc. Each firing pin has a sloped "conic" surface forming a cam which is in direct contact with a conic body-of-rotation inertia mass which lies on the projectile center-line. Upon impact, the conic shaped mass moves forward at a high rate forcing the firing pins outward at a much reduced velocity relative to that of impact. The moving firing pins pierce the rupture-discs and enter the stab primers, thereby causing the actuation of the latter.

7 Claims, 3 Drawing Figures

IMPACT IGNITION DEVICE FOR A PLURALITY OF STAB TYPE PRIMERS

BACKGROUND OF THE INVENTION

1. Field of the Invention

This invention relates to an improvement in explosive devices, and more particularly, is concerned with a multi-path impact type, inertia class, igniter for use with rotating and non-rotating projectiles or warheads.

2. Description of the Prior Art

The final functioning of a projectile or warhead is controlled by an explosive device commonly termed a fuze, initiator or igniter. The explosive device normally includes elements to set off the projectile, to prevent its premature functioning, and to cause it to function as desired only under predetermined conditions. These conditions determine the type of device that is needed. A general requirement for such devices, however, is that they shall normally be inactivated or desensitized for safe handling, transportation and storage.

Impact explosive devices are ones which function as they hit the target. Particular requirements for this type of explosive device is that it shall be non-responsive to the forward motion and axial rotation, if any, of the warhead resulting from being shot or otherwise launched toward a target, and that it shall be set off or detonated upon impact of the warhead with the target.

Inertia impact igniters are known in the prior art. One form of such igniter is disclosed in my copending application bearing Ser. No. 453,317, filed Dec. 27, 1982, and entitled "Inertia Type Friction Initiator for Rotating Projectiles, " which application has now matured as U.S. Pat. No. 4,515,080.

Another form of such impact igniter, comprising a dual or redundant flame path inertia igniter for warheads is disclosed in my copending application bearing Ser. No. 643,122, filed Aug. 22, 1984, and entitled "Double-path, Detonation Tube Inertia Igniter."

There exists a need, however, for improvement in redundant or multi-path impact type, inertia class, igniters for use with rotating and non-rotating projectiles or warheads. The devices of the prior art are complicated, expensive, and difficult to produce at a high and consistent level of quality.

SUMMARY OF THE INVENTION

An object of the invention is to provide an improvement in multi-path impact type igniters of the inertia class for use with rotating and non-rotating warheads.

Another object of the invention is to provide such an improved igniter that uses stab type primers without using a true striker or hammer or any springs.

Another object of the invention is to provide such an improved igniter in which the product shelf-life is that of the stab primers.

A further object of the invention is to provide such an improved igniter that may have as few as three movable parts and still be in static and dynamic balance.

Still another object of the invention is to provide such an improved igniter that has inherent nuclear blast/flash "hardness."

A still further object of the invention is to provide such an improved igniter that does not require any arming activity by personnel.

In accomplishing these and other objectives of the invention, two or more stab type "firing pins" are arranged in a plane that is located at an angle of substantially 90° with respect to the longitudinal center-line of the projectile. The firing pins are equally spaced apart on the plane, each being arranged to bear directly upon an individually associated safety rupture-disc. Each rupture-disc, in turn, bears directly upon an individually associated stab type primer or detonator, there being one primer per disc. Each firing pin has, at one end, a sloped "conic" surface forming a cam which is in direct contact with a conic body-of-rotation inertia mass, which mass lies on the longitudinal center-line of the projectile.

Upon impact of the warhead with the target, the impetus of the conic shaped mass moves it forward at a high rate of speed and forces each of the firing pins radially outwardly, that is, transversely with respect to the projectile center-line. The resulting movement of the firing pins is at a much reduced velocity relative to that of impact. Each moving firing pin pierces the associated safety rupture-disc, enters the associated stab primer, and actuates it. Each stab primer, in turn, communicates through an individually associated flash vent a firing or detonating reaction to a main explosive charge of the warhead.

The various features of novelty which characterize the invention are pointed out with particularity in the claims annexed to and forming a part of this specification. For a better understanding of the invention, its operating advantages, and specific objects attained by its use, reference is made to the accompanying drawings and descriptive matter in which a preferred embodiment of the invention is illustrated.

DESCRIPTION OF THE PREFERRED EMBODIMENT

Figure 1:
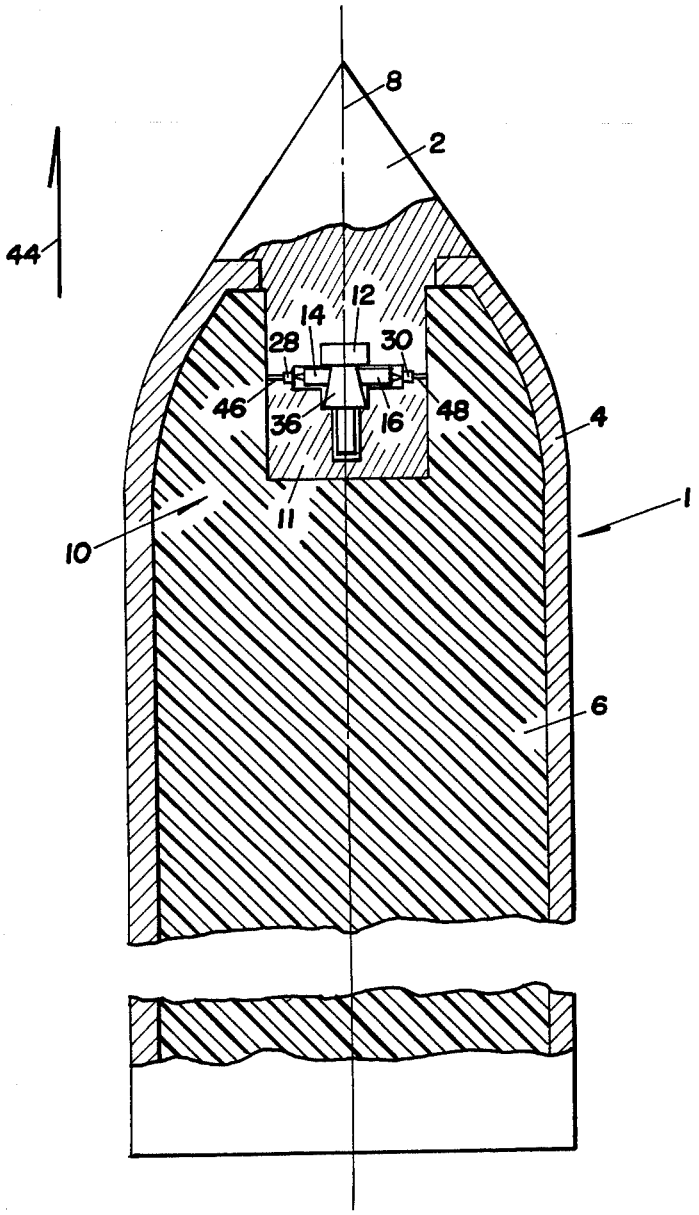
FIG. 1 is a fragmented cross sectional view of a projectile or warhead having the multi-path impact type inertia igniter of the present invention installed therein.

There is provided in the preferred embodiment of the invention, illustrated in the drawings, a multi-path impact type, inertia class, igniter for use with rotating and non-rotating projectiles or warheads. The igniter is designated generally by a reference numeral 10, and as those skilled in the art understand, may be installed in either the forward end or base of a warhead. In FIG. 1 the igniter 10 is shown installed in the forward end of a projectile 1 having an ogive 2 and an outer casing 4 containing an explosive charge 6. A longitudinal center-line for the projectile 1 is indicated by the numeral 8. The center-line 8 is parallel to the direction in which the projectile 1 is propelled.

Figure 2:
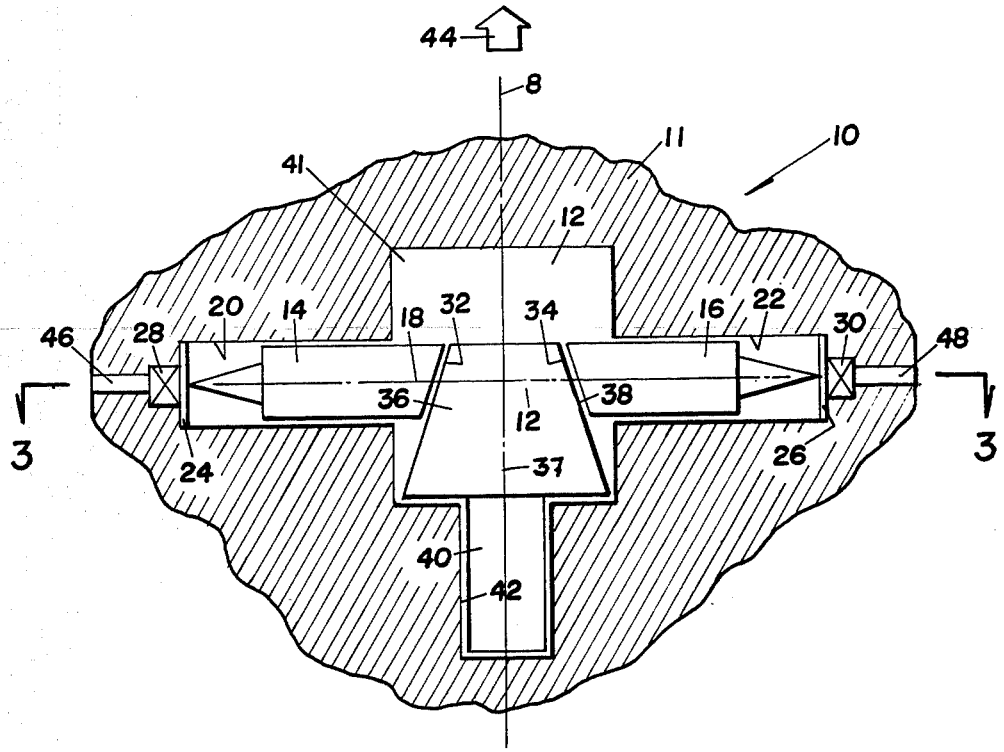
FIG. 2 is a view, on an enlarged scale, of a portion of FIG. 1 showing the multi-path impact type inertia igniter in greater detail.

The igniter 10, as best seen in FIG. 2 includes a housing 11 having formed therein a cavity 12 that contains two stab type or mass bearing firing pins 14 and 16. The firing pins 14 and 16, which may be cylindrical in form, are supported in a plane 18 that is located at an angle of 90° to the longitudinal center-line 8 of the projectile 1. The firing pins 14 and 16 are equally spaced apart and are arranged in oppositely facing manner away from the projectile center-line 8. More specifically, firing pin 14 is constrained for movement in a cylindrical space 20 that is formed in plane 18 within cavity 12. Similarly, firing pin 16 is constrained for movement in a cylindrical space 22 that is formed in plane 18 within cavity 12. Cylinders 20 and 22 are spaced apart and coaxially arranged, as shown in the drawings.

Each firing pin 14 and 16 bears directly, at a first end thereof, that remote from the other in each case, upon an individually associated safety rupture-disc. Thus, firing pin 14 bears at its first end upon a safety rupture-disc 24 and firing pin 16 bears at its first end on a safety rupture-disc 26. Rupture-discs 24 and 26 are fixed in position at the remote ends, respectviely, of cylinders 20 and 22. Disc 24 bears on a stab type primer 28. Similarly, disc 26 bears on a stab type primer 30.

Figure 3:
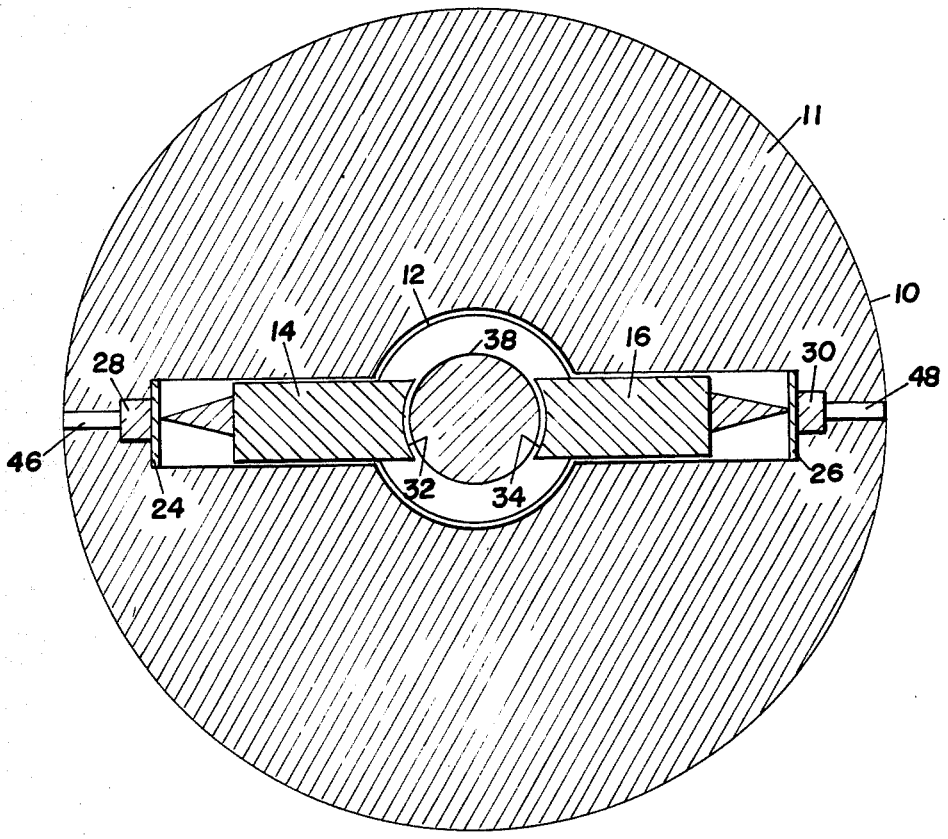
FIG. 3 is a cross sectional view of the multi-path impact inertia igniter of FIG. 2 taken along the lines 3—3 thereof.

At the other or second end thereof, each firing pin 14 and 16 has a sloped conic surface, the sloped conic surface on pin 14 being designated by numeral 32 and that on pin 16 by numeral 34. This is best seen by reference to FIGS. 2 and 3. Each of the sloped conic surfaces 32 and 34 forms a cam which is in direct contact with the surface 38 of a centrally located conic body-of-rotation inertia mass, designated by numeral 36. The mass 36 has a center-line 37 that is coincident with the center-line 8 of the projectile 1. Integrally formed with the inertia mass 36 and comprising part thereof is a shank 40 that is positioned in cylindrical space 42 in cavity 12. Cylinder 42 is formed on the center-line of projectile 1 and serves to constrain the direction in which the inertia mass 36 may move. Cavity 12 further includes a space or region 41 into which the conic inertia mass 36 may move upon impact of the projectile 1 with the target.

When completely assembled, the firing pins 14 and 16 and the inertia mass 36 are locked in position with the first ends of the firing pins 14 and 16 in engagement with and bearing on the respectively associated rupture-discs 24 and 26, and with the conic surfaces 32 and 34 at the respective second ends thereof in engagement with the conic surface 38 of the inertia mass 36. It is noted that the depth of the cylindrical space 42, in which the shank 40 of the inertia mass is positioned, is such as to maintain the components 14, 16 and 36 in a snug, locked position without placing the rupture-discs 24 and 26 under undue stress.

The direction in which the projectile 1 moves when shot or upon launch thereof is indicated in FIGS. 1 and 2 by the reference numeral 44. Upon impact with the target (not shown), the conic inertia mass 36 moves forward, relative to the projectile 1, at a high rate of speed and forces the firing pins 14 and 16 radially outward. The velocity at which the firing pins move radially outward is much reduced relative to that of the projectile 14, and hence, inertia mass 36 upon target impact. The moving pins 14 and 16 pierce the respectively associated safety rupture-discs 28 and 30 and enter the respectively associated stab type primers 28 and 30, thereby causing them to be actuated.

Flash vents 46 and 48 in the igniter 10 are respectively associated with the stab type primers 28 and 30. Thus, upon actuation of the stab type primers 28 and 30, a firing or detonating reaction is transmitted to the main explosive charge 6 of the projectile 1.

An important feature of the present invention is the freedom thereof from the requirement of any arming activity by operating or other personnel, no arming activity being required for the projectile 1 prior to being shot or launched.

In addition, the multi-path igniter may be used with both rotating and non-rotating projectiles or warheads. To this end, the rupture discs 24 and 26 are so selected as to have such strength and toughness as is required to preclude piercing thereof by firing pins 14 and 16 by centrifugal or other forces to which the projectile 1 may be subjected until the firing pins 14 and 16 are actuated by the force of the inertia mass 36 upon impact of the projectile 1 with the target. Shock and other forces encountered in the storage, transportation, and handling of the projectile 1 thus are rendered ineffective to cause the projectile to be fired prematurely or inadvertently with the attendant destruction of which the projectile 1 is capable.

By way of illustration and not limitation, it is noted that in the embodiment of the invention illustrated in the drawings, the several component parts may be made of materials such as those indicated below:

Ogive 2—steel forging or casting
Projectile outer casing 4—precision forging
Igniter housing 11—investment cast steel
Firing pins 14, 16—carbon steel (SAE 1060)
Rupture-discs 24, 26—high tensile cold rolled steel
Inertia mass 36—surface hardened steel Thus, in accordance with the invention, there has been provided an improvement in the art of igniters comprising a multi-path impact type, inertia class, igniter for use with rotating and non-rotating projectiles or other warheads. The improved igniter is characterized by the static and dynamic balance thereof, its incorporation of a stationary "idiot-proof" safety feature in the rupture-discs 24 and 26, and its freedom from the need for any arming activity by personnel. The invention enables the use of stab type primers without requiring the use of a true striker or hammer or any springs, and in addition, has inherent nuclear blast/flash "hardness."

While in the illustrated embodiment of the invention three moving parts only are used, those skilled in the art will recognize that, if desired, more than two firing pins and respectively associated rupture-discs, stab primers, and flash vents may be provided while still retaining the foregoing features and advantages. Thus, if three firing pins are utilized, they may advantageously be placed in a plane such as the plane 18, spaced apart from each other by an angle of 120°, instead of 180°, as in the illustrated embodiment. If four firing pins are utilized, they may be spaced apart, in the plane 18, by an angle of 90°. In each of such modified versions of the illustrated multi-path impact type inertia class igniter, the igniter will still be in static and dynamic balance.

What is claimed is:

1. A multi-path impact type igniter for a projectile having a center-line that is parallel to the direction in which the projectile is launched comprising, a plurality of stab type primers, a plurality of rupture-discs, each of said rupture-discs being arranged to bear directly upon an individually associated one of said stab type primers, an inertia mass having the shape of a conic body of rotation, said mass having a center-line that is coincident with the projectile center-line, and a plurality of firing pins each of which have a first end and a second end, said firing pins being equally spaced apart and so supported for movement in a plane that is at an angle 90° with respect to the projectile center-line that each of said firing pins faces away from the projectile center-line with the first end thereof bearing directly on an individually associated one of said rupture discs, each of said firing pins having at the second end thereof a sloped conic surface forming a cam that is arranged in direct contact with said conic body-of-rotation inertia mass, whereby upon impact of the projectile with a target after being propelled through space the inertia mass moves forward, due to the impetus thereof, at a high rate relative to the projectile and forces said firing pins away from the projectile center-line to pierce the associated rupture-disc and to enter and thereby actuate the associated stab type primer.

2. A multi-path impact igniter as defined by claim 1 further including, a housing for said igniter, said housing having a cavity formed therein, said cavity containing said stab type primers, said rupture-discs, said inertia mass, and said firing pins.

3. A multi-path impact igniter as defined by claim 2 wherein said firing pins are each cylindrical in form, and wherein said cavity includes a plurality of cylindrical spaces formed therein in the plane in which said firing pins are supported with said firing pins being positioned in and constrained for movement within an individually associated one of said cylindrical spaces.

4. A multi-path impact igniter as defined by claim 3 wherein a shank is integrally formed on said inertia mass, and wherein said cavity includes a cylindrical space that is formed on the longitudinal center-line of the projectile with said shank of said inertia mass positioned in last mentioned cylindrical space and constrained for movement therein.

5. A multi-path impact igniter as defined by claim 4 wherein the depth of the cylindrical space in said cavity that is formed on the longitudinal center-line of the projectile is such that when assembled the firing pins and the conic inertia mass are maintained in a snugly fitting locked relation in said cavity with the first ends of said firing pins bearing on the respectively associated rupture-disc and the conic surfaces at the second ends of said firing pins in engagement with the conic surface of said inertia mass.

6. A multi-path impact igniter as defined by claim 5 wherein said cavity further includes a region within which said inertia mass is allowed to move when moved forward due to the impetus thereof upon impact of the projectile with a target.

7. A multi-path impact igniter as defined by claim 6 further including a plurality of flash vents in said housing, one of said flash vents being associated with each of said stab primers whereby upon impact of the projectile with the target and subsequent actuation of said stab primers a firing reaction may be transmitted to a main explosive charge of the projectile.

* * * * *